United States Patent [19]

Puskar

[11] 4,383,387

[45] May 17, 1983

[54] TWIRLING BATON

[76] Inventor: Frank J. Puskar, 107 Elm Rd., Pittsburgh, Pa. 15239

[21] Appl. No.: 267,093

[22] Filed: Jul. 30, 1981

[51] Int. Cl.[3] ..... A63H 1/32; G09B 15/02

[52] U.S. Cl. ..... 46/47; 84/477 B

[58] Field of Search ..... 46/47, 49, 1 R; 84/477 B, 477 R; 273/72 R, 72 A, 81.2, 80 D

[56] References Cited

U.S. PATENT DOCUMENTS

| | | | |
|---|---|---|---|
| 3,003,385 | 10/1961 | Taylor | 84/477 B |
| 3,069,804 | 12/1962 | Cirafesi | 46/47 X |
| 3,070,370 | 12/1962 | Steiner | 273/81.2 X |
| 3,509,659 | 5/1979 | Kau | 46/47 |
| 3,810,411 | 5/1974 | Schambacher | 84/477 B |

FOREIGN PATENT DOCUMENTS

| | | | |
|---|---|---|---|
| 492684 | 9/1938 | United Kingdom | 273/81.2 |

*Primary Examiner*—Mickey Yu

[57] ABSTRACT

An adjustable baton to be used for twirling is provided having an elongated shaft formed from a hard material such as stainless steel. A resilient ball is mounted at one end of the shaft and a smaller resilient tip is mounted at the other end thereof. The shaft comprises three axially aligned tubular pieces, namely a main shaft with an extension shaft mounted at each end thereof. Mating internally frusto-conical surfaces are formed at the ends of the main shaft and the extension shaft at each end of the main shaft has a mating externally frusto-conical surface to be received by the mating surface of respective end of the main shaft. A threaded rod internally received by each extension shaft and one end of the main shaft is provided for each extension shaft to connect the extension shafts to the main shaft. Adjustment is accomplished by extracting a desired length of threaded rod from inside the main shaft. Adjustable threaded bushing to eliminate play between the rod and the respective extension shaft and these parts are fastened securely by a locking device such as a lockwasher and nut. The tip end has a weight therein to counterbalance the larger resilient ball at the other end of the shaft. The length of the baton is adjusted by substituting extension shafts of different lengths.

4 Claims, 6 Drawing Figures

TWIRLING BATON

FIELD OF INVENTION

This invention relates to batons for twirling purposes, but more particularly to batons that may be adjusted.

DESCRIPTION OF THE PRIOR ART

It is common to use a baton for twirling. A typical performance includes the manipulation of twirling the baton over and under the arm for example, while carrying out a dance routine in response to music. The music may be supplied by a band such as at parades and football games or artifically from recordings as is ususally the case when one is young and striving to become the accomplished twirler.

Twirling batons include an elongated shaft, generally made of a hard material such as stainless steel. A resilient "ball" is mounted at one end and a somewhat smaller resilient tip at the other end. Although the tip is somewhat smaller than the ball, the ball and the tip are conventionally somewhat symmetrical and conical in shape generally. The elongated shaft is generally held in the middle between the fingers and the thumb and is generally twirled over and under the arm.

One problem with the traditional baton is sizing. Being that it is generally twirled over and under the arm, the batons are measured to size by the twirler's arm length. Baton twirling is an activity also associated with the very young, and as one grows the baton becomes too small and is useless to the twirler, becoming inconvenient and economically unfeasible for the upcoming accomplished twirler.

Workers in the art have never been able to overcome this problem. Most, if not all, improvements have been directed to other areas such as providing a shaft with dazzling appearances, U.S. Pat. No. 3,113,482, or a twirling baton directed for ease of rotation, U.S. Pat. No. 3,962,949. Such developments do nothing to assist the twirler overcome their sizing impediment.

SUMMARY OF THE INVENTION

A novel baton for twirling is provided, which solves the problem associated with batons designed by workers in the art. The invention can be easily adjusted to any size person. The baton is formed from an elongated shaft, cut at the ends on an angle. The ends are fastened together by a threaded rod, generally made of a hard light material. They then are tightened together securely by a locking device, such as a lockwasher and a nut. The design of the adjustment is critical to the effectiveness of the invention. The shafts to be joined are cut on angles congruent to each other as to be seated with a tight tolerance fit. The main shaft has a permanently fixed threaded sleeve inserted on the inside. A threaded rod having a fixed "bushing" on one end threads into the sleeve. The fixed bushing circumference again has a tight tolerance fit to the main inner diameter shaft eliminating any seesaw play. The other end of the threaded rod protruding out of the main shaft has a slit to allow for extracting out of the main shaft by a tool such as a screwdriver. It is understood that even though a fixed threaded sleeve is inserted into the main shaft that the shaft itself may be tapped to receive the threaded rod. I am using a fixed threaded shaft to keep the weight of the baton to a minimum. Tapping the main shaft would present the heavier walls increasing the baton's weight. The adjustment is made by unscrewing from the main shaft a portion of the threaded rod to a desired length. Adding a bushing or two depending on the added length of the extension shaft to the protruding rod will eliminate any seesaw play with the added extension. It is then tightened securely together with the locking device.

The baton is an elongated shaft and capped with rubberized ball ends. The shaft is usually grasped in the middle by the twirler, between the user's thumb and fingers and the rubber balls on both ends of the shaft. Thus, the user's thumb and fingers will not come in contact with the adjusted shaft, nullifying any unnatural feel where the parts are joined. It is imperative that the shafts to be joined are free from any foreign material protruding from the outer surface of the shaft adjustment "slit." Even though the baton is generally twirled under and over the arm, it is understood that there are other uses; for example, one is when the twirler lets the baton slide from the middle of the shaft to the ball end, grasping the ball to toss the baton in the air. Any foreign material used on the outer diameter surface of the shaft where they are joined for added support may prevent the twirler from executing their routine properly.

The present invention overcomes all the problems associated with batons designed by other workers in the art. First, the present invention provides a baton that may be readily adjusted. Second, the present invention is now conveniently economically feasible. Instead of constantly buying an entire new baton, the twirler has only to add the needed extension shaft saving the main shaft. Third, the twirler still has the natural "feel" of the adjustment shaft, being that the adjustment is made at the far ends away from the twirler's hands. Finally, fourth, the baton is still a well-balanced baton with a weight on one end acting as a locking device. The baton still has a unispherically sound shaft which is strong. No foreign objects are assisting its strength on the outer portions.

DESCRIPTION OF THE PREFERRED EMBODIMENT

Reference may be made to FIGS. 1, 2, 3, 4, 5, and 6 to enhance the understanding of the description of the preferred embodiment.

Figure 1:
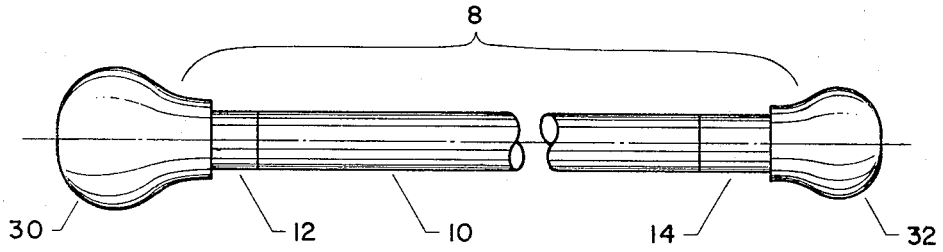
FIG. 1 is a perspective view of the adjustable twirling baton as a unit.
Figure 2:
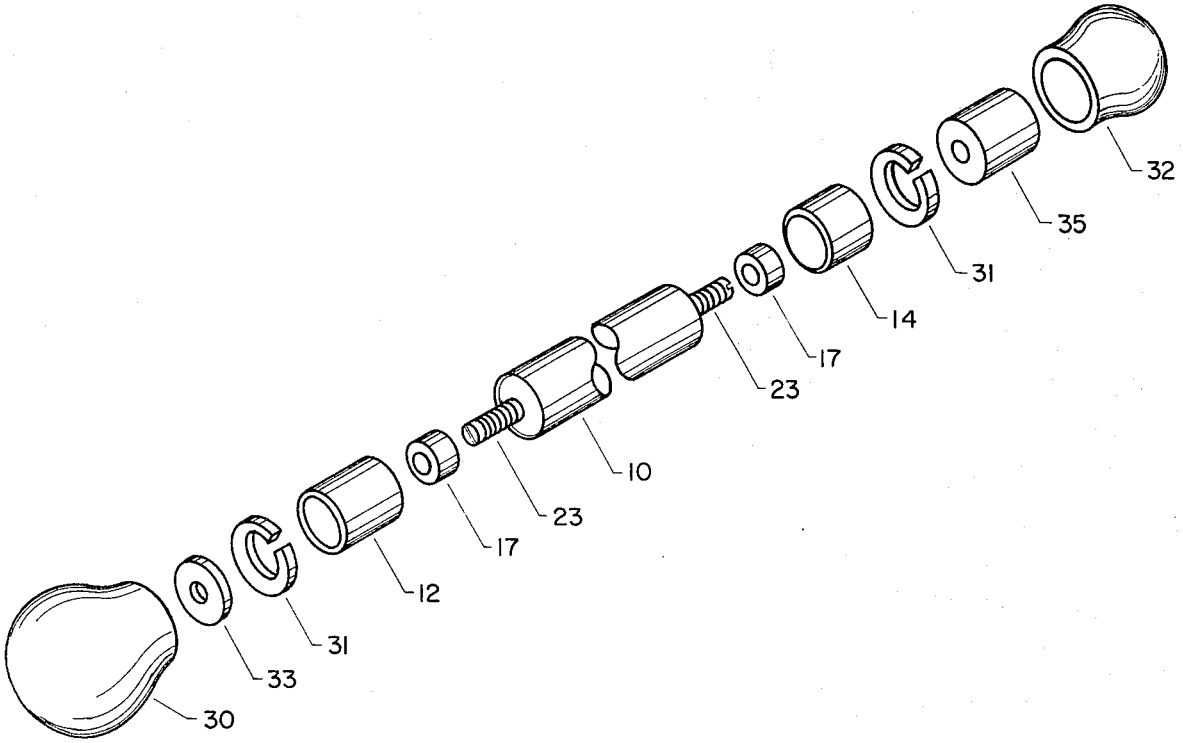
FIG. 2 is an exploded view of the adjustable twirling baton showing the order of assembly of various parts.
Figure 3:
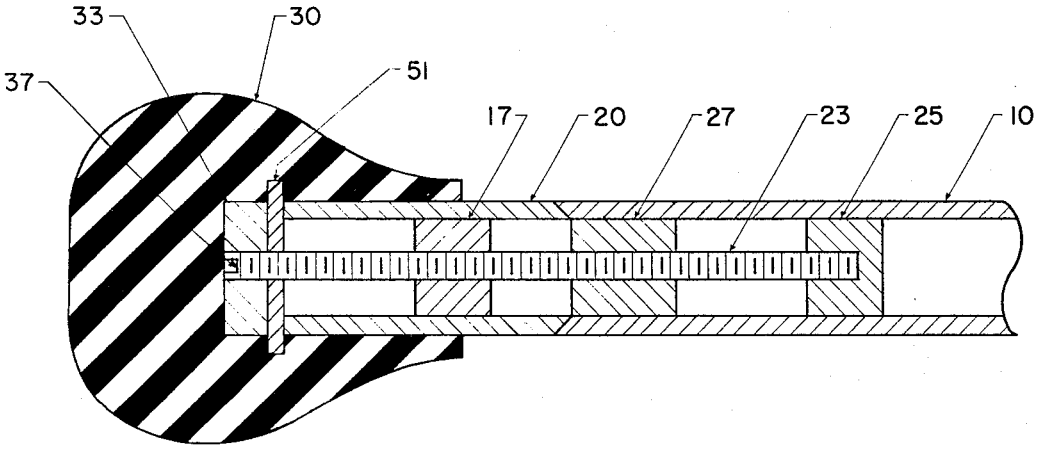
FIG. 3 is an enlarged cross-sectional view of the ball end of the shaft showing the added adjustment.

The twirling baton 8 shown in FIG. 1 includes a main shaft 10 with an added extension shaft 12. A resilient body or a ball 30 mounted on its end. The tip end of the main shaft 10 consists of a shorter added extension shaft 14 with a somewhat smaller resilient tip 32 mounted on its end. The main shaft 10 and added extensions 12 and 14 are generally formed from a high polished or chromed tubular metal such as stainless steel. Although other materials such as plastics or solid metal could be employed, a counter-balancing weight 35 on FIG. 2 is generally employed to balance the tip 32 against the ball 30. Although another weight could be used in the ball 30 as well, the weight establishes the center of gravity of the baton at approximately the longitudinal center of the shaft.

Figure 4:
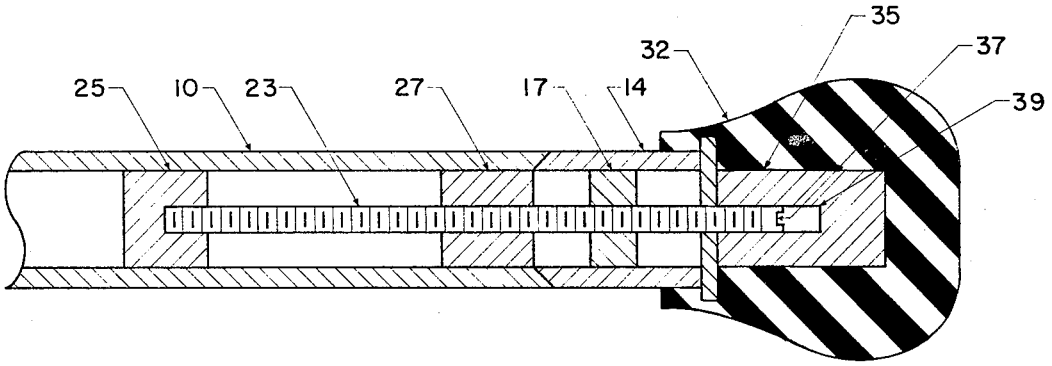
FIG. 4 is an enlarged cross-sectional view of the tip end consisting of the counter balancing weight and showing the added adjustment.
Figure 5:
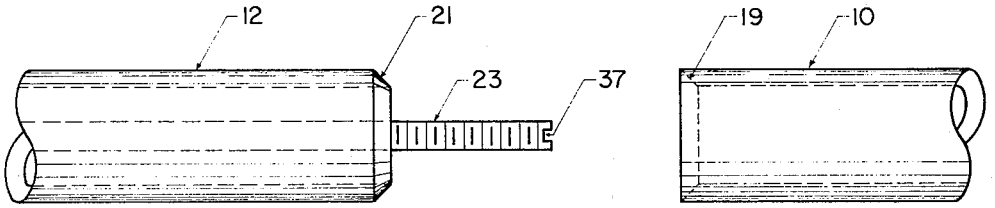
FIG. 5 is a view showing the chamfered and the mating internal chamfer tapered angle.
Figure 6:
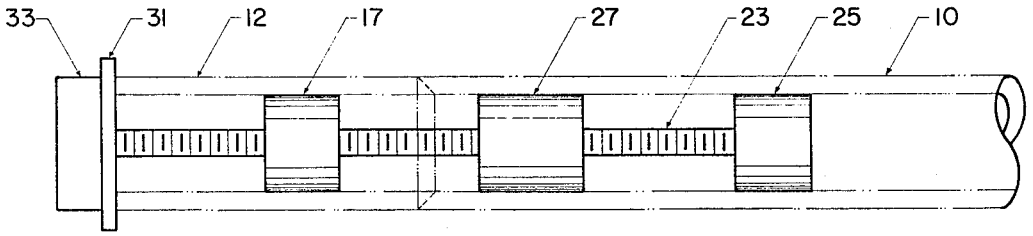
FIG. 6 is a view of the interior shaft showing the threaded rod and bushings, fixed threaded sleeve, and locking device used in the adjustment mechanism.

In accordance with the invention, main shaft 10, ball end 30 includes a "frusto-conical" mating internal chamfer 19 on FIG. 5 to receive a frusto-conical external chamfer 21. The main shaft 10 also includes a fixed threaded sleeve 27, FIG. 6 to receive the threaded rod 23. Notch 37 is employed on the threaded rod to extract the threaded rod from the main shaft 10. A fixed greased bushing 25, FIG. 6, on the threaded rod 23 provides cantilevered support to eliminate any "see-saw" movement. Bushing 25, FIG. 6, is greased to release the friction occuring between the inner walls of main shaft 10 and the outer portion of the bushing 25 as the threaded rod 23 is adjusted. Adjustable threaded bushings 17, FIG. 2, are added to the protruding threaded rod 23 again to eliminate any play from the added extension shaft 12 and 14, FIG. 2. After the threaded rod 23 is adjusted to the needed length of extension shaft 12, a lockwasher 31 with a circular type nut 33 is added on the end and tightened down securely. Lockwasher 31 serves two functions: number one as a locking device for the adjustment shafts and number two as a ball or tip securer. The shoulder 51 of lockwasher 31, FIG. 3, grips the rubberized ball or tip preventing axial movement between the ball or tip and shaft. It is imperative that the angle 21 and of the "frusto-conical" mating internal chamfer 19, FIG. 5, are equal to each other for a tight tolerance fit. A 45 degree angle is generally preferred. The tip end 32 has all the same features as ball end 30 except for the addition of the counter-balancing weight 35, FIG. 4. Also included is a somewhat shorter added extension shaft 14, to counterbalance the added length of the extended shaft 12 at the other end of shaft 10, FIG. 3. The balance weight 35 acts as a weight and nut combined. Space 39, FIG. 4, is employed to add a little recess to threaded rod 23 so it can be tightened down securely.

It should be understood that the invention is not limited to this precise construction, and that other constructions are within the scope of the invention. The main shaft 10 may have either the "frusto-conical" mating internal chamfer or the external chamfer. The extended shaft may have either one also. The 45 degree angle is preferred although others may be employed. The main shaft 10 may be tapped directly, eliminating the fixed bushing 27, FIG. 6, attached to the main shaft 10. The adjustable bushing 17 and fixed greased threaded rod bushing 25 for weight purposes are designed and shown as above.

What is claimed is:

1. An adjustable balanced twirling baton comprising an elongated hollow cylindrical main shaft, a short hollow internally threaded tubular extension shaft at one end of said main shaft, a first threaded adjusting rod internally received by and connecting together said shafts, a longer internally threaded tubular extension shaft at the other end of said main shaft, a second threaded adjusting rod internally received by and connecting together said main shaft and said longer extension shaft, said main shaft having a frusto-conical mating surface on each end, a frusto-conical mating surface on one end of each extension shaft to mate with the respective mating surface at the ends of said main shaft, a fixed bushing on one end of each of said adjusting rods slidably received within said main shaft, an adjustable bushing threadedly mounted on a central portion of each of said adjusting rods and slidably received within the respective extension shafts, an internally threaded locking device threadedly mounted on the free end of each adjusting rod to secure said extension shafts in abutting contact with the respective ends of said main shaft, a resilient ball mounted on the free end of said longer extension shaft and a smaller resilient tip mounted on the free end of said short extension shaft.

2. An adjustable twirling baton as set forth in claim 1, an adjustable internally threaded weight bushing adjustably mounted on the threaded adjusting rod within said short extension shaft.

3. A baton as set forth in claim 1 wherein said main shaft frusto-conical surfaces are concave internal surfaces and said extension shaft frusto-conical surfaces are external surfaces.

4. A baton as set forth in claim 1 wherein each end of said main shaft has a fixed internally threaded sleeve inserted within and secured to the inner surface of said end.

* * * * *